United States Patent [19]

Clement et al.

[11] 4,412,367

[45] Nov. 1, 1983

[54] ELECTRIC STOP MOTION APPARATUS FOR A TEXTILE MACHINE

[75] Inventors: Heinz Clement; Christina Furrer, both of Winterthur, Switzerland

[73] Assignee: Rieter Machine Works Limited, Winterthur, Switzerland

[21] Appl. No.: 250,942

[22] Filed: Apr. 6, 1981

[30] Foreign Application Priority Data

Apr. 23, 1980 [CH] Switzerland ..... 3127/80

[51] Int. Cl.[3] ..... D01G 31/00; B65H 25/14; D01H 13/16

[52] U.S. Cl. ..... 19/0.25; 19/239; 200/61.13; 200/61.18

[58] Field of Search ..... 19/0.25, 236, 239; 200/61.13, 61.18

[56] References Cited

U.S. PATENT DOCUMENTS

| | | | |
|---|---|---|---|
| 7,643 | 7/1935 | Exley | 19/0.25 |
| 1,701,127 | 2/1929 | Scott | 19/0.25 |
| 1,722,769 | 7/1929 | Scott | 19/0.25 |
| 1,795,799 | 3/1931 | Scott | 19/0.25 |
| 2,956,392 | 10/1960 | Ohnishi | 19/0.25 |
| 3,271,823 | 9/1966 | Whitehurst | 19/0.25 |
| 3,305,896 | 2/1967 | Rayfield et al. | 200/61.18 X |
| 3,310,844 | 3/1967 | Robertson | 19/0.25 |
| 3,345,695 | 10/1967 | Rayfield et al. | 19/0.25 |
| 4,065,831 | 1/1978 | Huntsinger | 19/0.25 |
| 4,095,062 | 6/1978 | Savageau | 200/61.13 |

FOREIGN PATENT DOCUMENTS

| | | | |
|---|---|---|---|
| 914664 | 10/1946 | France | 19/0.25 |
| 1145177 | 10/1957 | France | 19/0.25 |
| 1422292 | 11/1965 | France | 19/0.25 |
| 471945 | 9/1937 | United Kingdom | 19/0.25 |
| 743612 | 1/1956 | United Kingdom | 19/0.25 |
| 732382 | 6/1955 | United Kingdom | 19/0.25 |
| 817190 | 7/1959 | United Kingdom | 19/0.25 |

*Primary Examiner*—Louis Rimrodt
*Attorney, Agent, or Firm*—Werner W. Kleeman

[57] ABSTRACT

In textile machines fed with fibre slivers, such as e.g. drawframes, immediate stopping of the machine is required in case of a sliver breakage before or on the feed table. This requirement is fulfilled using the inventive stop motion apparatus quickly and reliably, by tilting a pan arranged beneath each normally running fibre sliver and which does not contact such fibre sliver. The reaction time of the stop motion apparatus can be shortened by providing a heavy body on, and movable with respect to, the pan, the body being e.g. in the form of a steel ball. Since the pan in its working position does not contact the normally running fibre sliver, slivers of improved quality are produced and contamination of the stop motion apparatus is avoided.

8 Claims, 8 Drawing Figures

Fig. 4
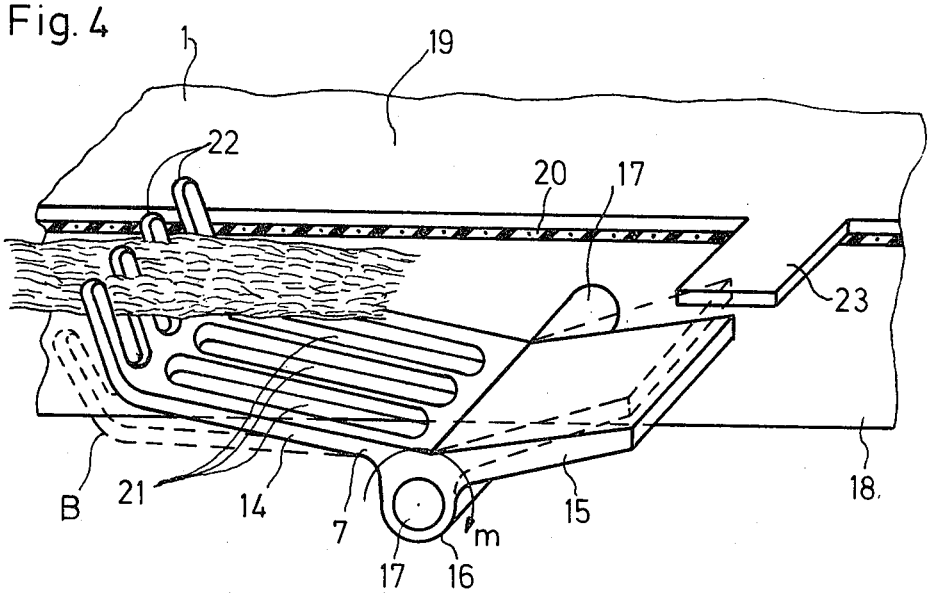
Fig. 5
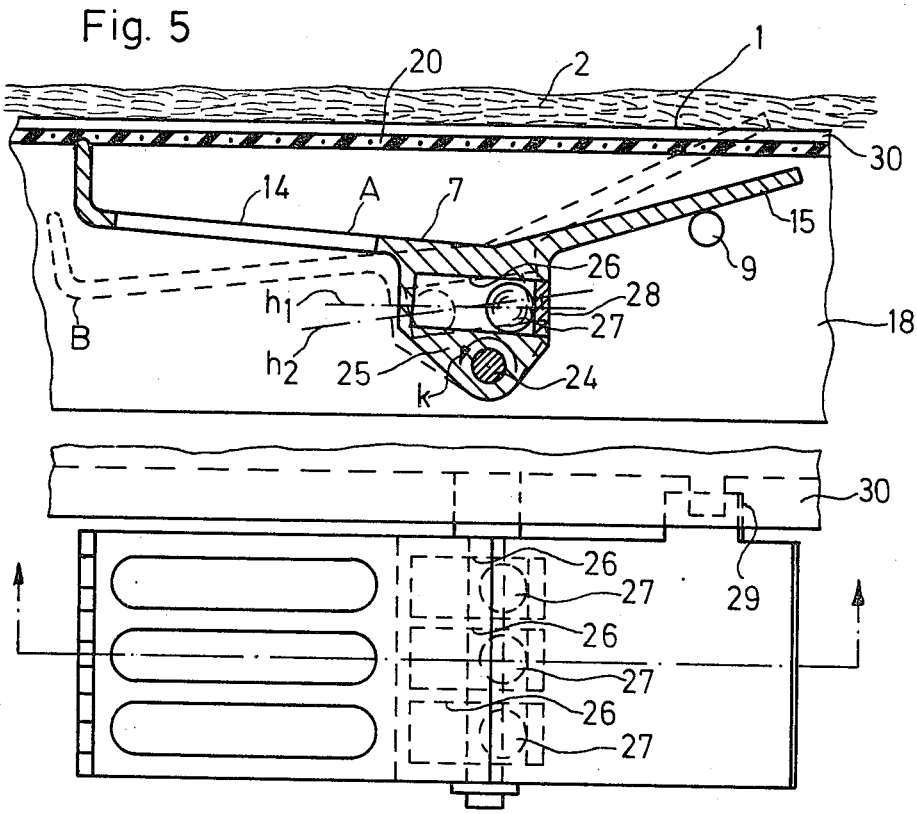
Fig. 6

ELECTRIC STOP MOTION APPARATUS FOR A TEXTILE MACHINE

BACKGROUND OF THE INVENTION

The present invention concerns an improved electric stop motion apparatus for a textile machine fed with fibre slivers, in particular for a drawframe, containing a pan or rocker for each input sliver, which pan is tiltable between a working position and a stop position, tilting of such pan being effected by the running out of the fibre sliver and serving to activate an electric stop motion contact.

In textile machines fed with fibre slivers, such as e.g. drawframes, a plurality of fibre slivers are withdrawn from creel cans and are supplied to the drafting arrangement via a feed table, on which the fibre slivers are carefully lined up side by side. If only one of the fibre slivers to be supplied is absent for any reason, e.g. because the corresponding creel can is empty, or because the fibre sliver supply is interrupted, the machine is to be stopped immediately, in order to avoid production of faulty fibre sliver, i.e. of a fibre sliver with too small a weight. The stopping action furthermore is to be effected within a very short time, in such a manner that the end of the sliver running out cannot be taken-in into the drafting arrangement. As long as the end of the sliver still is located on the feed table, the leading end of a new sliver can be connected manually to the end running out, which is effected by "piecing", in such a manner that no faulty portion is produced in the fibre sliver delivered from the machine. If this is not the case, however, i.e. if the sliver end running out reaches, or passes through, the drafting arrangement, before the sliver breakage is detected and the machine is stopped, a certain fibre sliver portion of lower fibre content unavoidably is produced, which portion is to be eliminated, if no risk of production of faulty finished products (woven or knitted fabrics, etc.) is to be taken into account. Furthermore the insertion of the new sliver leading end in the drafting arrangement is an operation which is much more complicated and time-consuming than the above mentioned "piecing".

Thus, numerous stop motion devices were developed during the course of time, and the continuing increase in the operating speeds imposing more demanding requirements, particularly with respect to the reaction speeds required.

The various known devices of this type, of which as an example the device according to the German Pat. No. 909,550 is mentioned, function according to the principle of sliver detection using a feeler lever. In the absence of a sliver the lever can move from an operating position, in which the lever is supported by throughpassing sliver, to a stopping position, usually by performing a tilting movement, this movement being used for activating an electric stopping contact.

In the above mentioned solution according to the German Pat. No. 909,550 the throughpassing fibre sliver is detected using a pan-type flap which is tiltable to one side, which activates the stopping switch, and which from below is held in contact with the throughpassing fibre sliver by using a tongue. Similar solutions using direct detection of the throughpassing sliver are known in great numbers, in which the sliver is detected from above, instead of from below as in the patent mentioned here. As an example of a device using detection from above, there is to be mentioned for instance U.S. Pat. No. 3,305,896.

All these known solutions show considerable disadvantages stemming from the direct feeler detection. These disadvantages are, among others:

(a) Formation of so-called "fibre beards" on the feeler lever. In the margin zones of the feeler element, which no longer are sufficiently swept by the throughpassing sliver, i.e. where the contacting pressure is lowest, fibres can cling, for which smallest rough spots are sufficient, which eventually lead to fibre accumulations. Such accumulations from time to time are released and are carried on by the sliver, in such a manner that a fault is generated in the sliver which is produced.

(b) Such feeler elements swept by the material are subject to contamination by fibre and dust particles contained in the material itself, which contamination can impair the reliability of the stop motion device. Since fibre slivers as a rule cannot withstand high tensile stresses, the feeler elements necessarily are to be designed as elements functioning under feable forces. Small changes in the frictional properties of the feeler lever thus already can influence the activation susceptibility of the stop motion device, the stopping function thus becoming unreliable.

(c) There is a dependency upon the type of material which is processed, particularly upon its volume. It is well known that fibre slivers of the same weight can differ considerably in their cross-section areas, depending on e.g. the degree of crimp and parallelism of the fibres, but also on the degree of compression the slivers undergo, as they are deposited in cans. Thus, in sliver-feeling stop motion devices adaptations to the material which is being processed may possibly prove necessary for ensuring optimum working conditions.

SUMMARY OF THE INVENTION

An important object of the present invention thus is to propose an electric stop motion apparatus of the type mentioned initially, by means of which the above-mentioned disadvantages of the known devices are eliminated and which, above all, ensures for an absolute functional reliability.

Now in order to implement this object and others, which will become more readily apparent as the description proceeds, the electric stop motion apparatus for a textile machine fed with fiber slivers, particularly a drawframe, contains a respective pan or rocker provided for each input fiber sliver, such pan or rocker being tiltable between a working position and a stop position. The tilting of the pan or rocker is effected by the running out of the related fiber sliver and serves to actuate an electric stop motion contact. Importantly, the pan is arranged beneath the normally running fiber sliver without touching such fiber sliver and is arranged to be tiltable about a horizontal tilt or pivot axis disposed perpendicular to the fiber sliver direction. The mass distribution of the pan is chosen such that in its work position it automatically bears against a stop, and that tilting of such pan into its stop position is effected under the influence of an outer force which overcomes the self-retaining force, while passing through a dead-center or unstable neutral position.

At least one body formed of a relatively heavy material may be guided on the pan or rocker so as to be movable at right angles to the tilt or pivot axis in a manner such that, upon passing through the dead-center or neutral position, the body moves relative to the pan and causes an increase of the tilt moment or torque which is effective upon the pan or rocker. In this way there is provided a particularly advantageous construction affording enhanced activation speed or response of the stop motion apparatus.

The body or body member may be constituted by a steel ball which is movable in an elongate chamber.

Additionally, the part of the pan or rocker which is directed in the lengthwise direction or direction of movement of the fiber sliver can be provided with substantially comb-shaped teeth. This affords improved functional reliability of the electric stop motion apparatus.

The pan or rocker can be designed so as to have a low mass. This also enhances the activation speed or response of the stop motion apparatus. To that end, it is contemplated to construct the pan or rocker from a light metal alloy.

Additionally, a particularly simple and economically feasible design of electric stop motion apparatus can be attained if the tilt or pivot axis of the pan or rocker is mounted on and is electrically insulated from a feed table. The stopping contact can be realized in that the pan comes into contact with the table in the stopping or shutdown position.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 4 is a perspective view of a modified embodiment of stop motion apparatus according to the invention;

FIG. 5 illustrates a further embodiment of stop motion apparatus depicted in end or lateral view; and FIG. 6 illustrates the stop motion apparatus depicted in FIG. 5 in a top plan view.

DETAILED DESCRIPTION OF THE PREFERRED EMBODIMENTS

Figure 1:
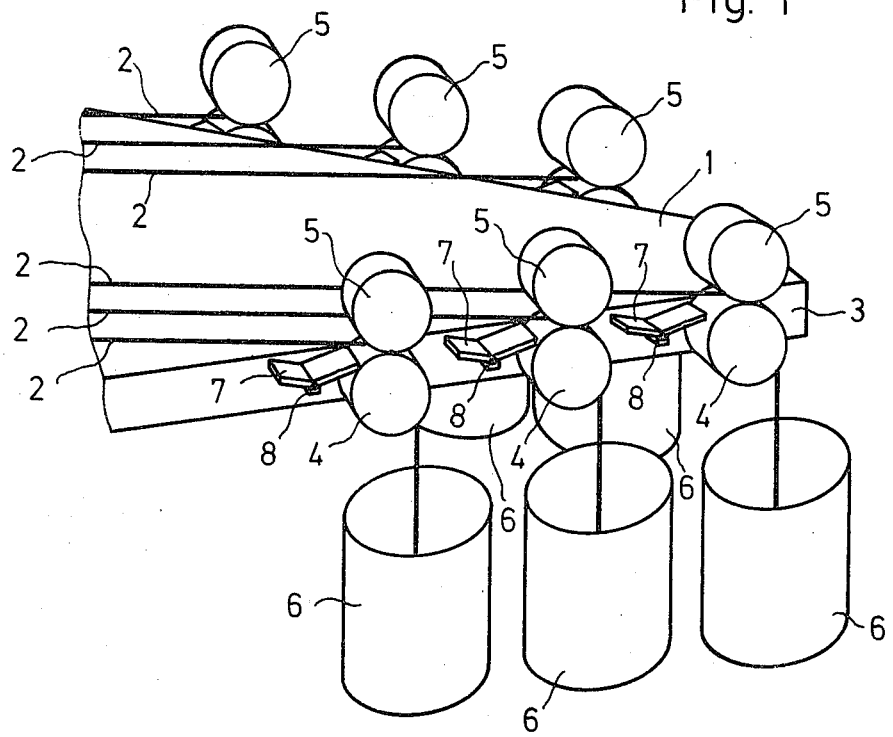
FIG. 1 is a fragmentary perspective view of a feed table of a drawframe containing an exemplary embodiment of electrical stop motion apparatus according to the invention.

The feed table 1 (FIGS. 1 and 2) of a drawframe (not shown in detail in FIGS. 1 and 2 and indicated here as an example and merely representative of a number of other textile machines) is used for supplying a plurality of fibre slivers 2 to the working elements of the textile machine, e.g. to the drafting arrangement in the case of a drawframe in an orderly arrangement, i.e. mutually parallel. For this purpose at the lateral rims 3 of the table 1, which diverges towards the machine, there are arranged pairs of rolls 4/5, the lower roll 4 of each pair being rotatably supported at the table rim 3 and being driven by means not shown (e.g. toothed belts). The upper roll 5 as a rule is designed as a pressure roll, i.e., with respect to the lower roll 4 it is freely movable at right angles and is pressed against said lower roll 4 either by its own weight or by additional pressure means (not shown) and is driven merely by the lower roll 4 by frictional contact. Below each pair of rolls 4/5 there is arranged a sliver can 6 from which the sliver 2 is withdrawn by the pair of rolls 4/5. The inventive electric stop motion apparatus ensures control of each individual fibre sliver 2 supplied to the feed table 1, in such a manner that the textile machine is stopped immediately if one of the fibre slivers 2 no longer is supplied correctly to the working elements. Such an absence of fibre sliver supply can be due to different causes: it can be due to exhausted sliver can content, or to sliver breakage between the can 6 and the corresponding pair of rolls 4/5. It also can occur e.g. in that the fiber sliver 2 breaks on the table 1, i.e. between the pair of rolls 4/5 and the working elements (not shown), in such a manner that transport of the sliver 2 on the table 1 no longer is possible. The inventive stop motion apparatus in all these cases is intended to stop the whole textile machine reliably and, above all, quickly, and in such a manner in any case, that the fibre sliver end running out on the table 1 remains on the table 1, and thus, can be pieced manually to the leading end of a fibre sliver.

Figure 2:
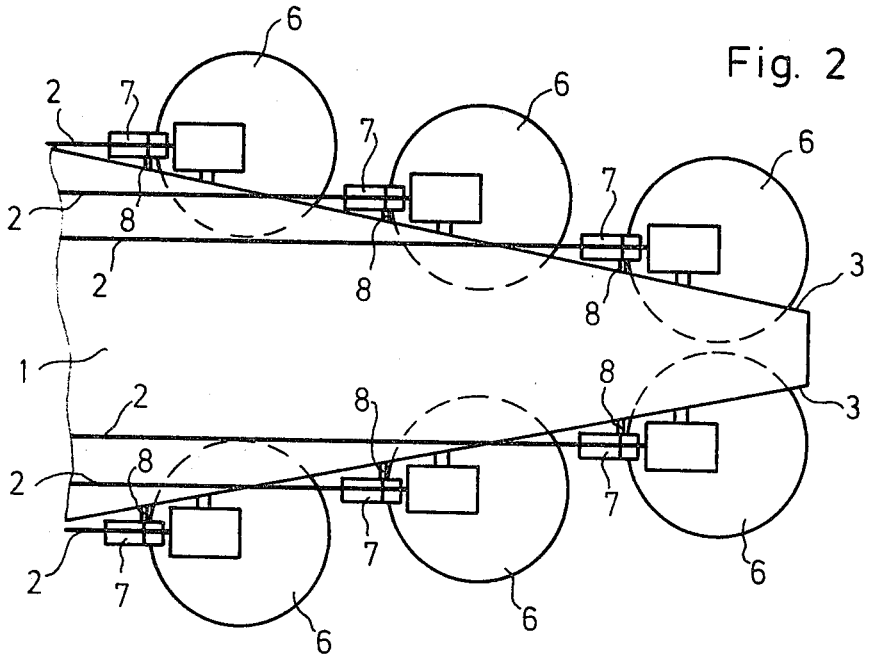
FIG. 2 is a top plan view of the feed table arrangement depicted in FIG 1.

The electric stop motion apparatus according to the invention substantially consists of a pan or rocker 7 coordinated to each fibre sliver 2, tiltable between a working position and a stopping position, which as shown in FIGS. 1 and 2, is supported to be tiltable about a tilting or pivot axis 8, at the immediate vicinity of the pair of rolls 4/5.

Figure 3A:
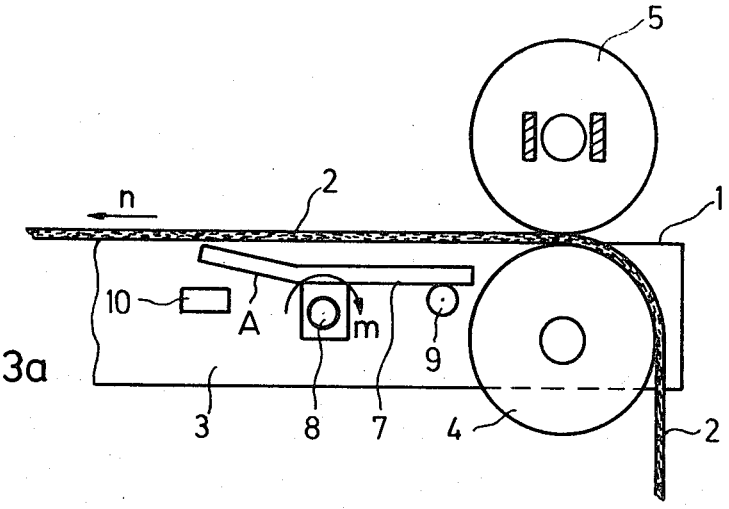
FIGS. 3*a* through 3*c* illustrate in schematic view three different possible working phases of the stop motion apparatus of the invention.
Figure 3B:
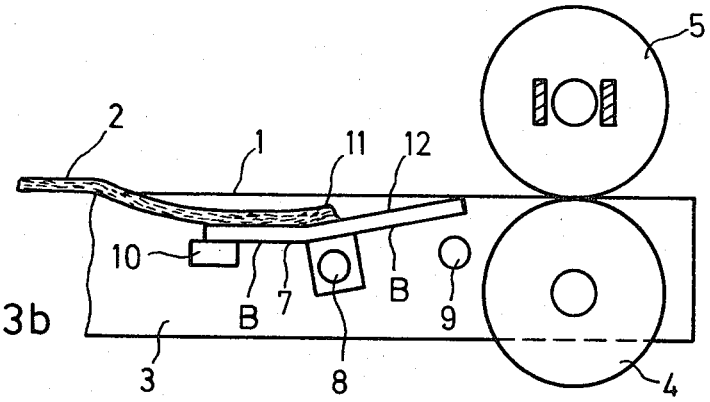
Figure 3C:
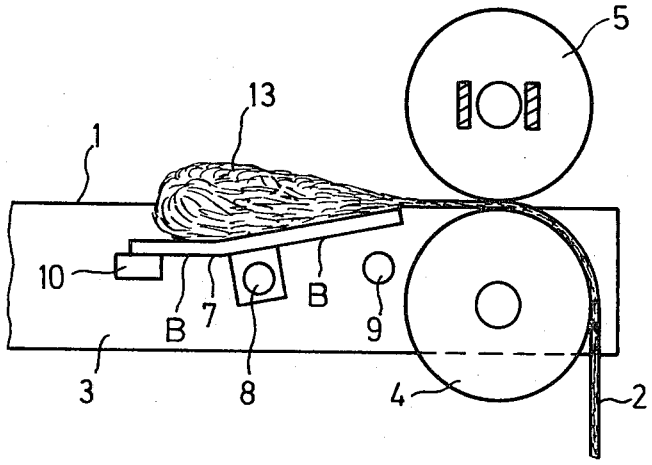

In FIGS. 3*a* through 3*c* the design details and the function of the inventive stop motion apparatus are shown in an enlarged, schematic view. The elements corresponding to the ones shown in FIGS. 1 and 2 also here are designated with the same reference numbers.

In FIG. 3*a* the inventive stop motion apparatus is shown during the correct operation of the machine. The pan or rocker 7 here is shown in its working position A, in which, according to the invention it is arranged below, but without contacting the normally running fibre sliver 2, and is tiltable about the tilting axis or shaft 8. In this arrangement, according to the invention, the mass distribution of the pan 7 is chosen such, that in the working position A shown here, the pan 7 is under the influence of a torsion or rotational movement m about the tilting or pivot axis 8 (directed clockwise in this Figure, in which the fibre sliver 2 moves on the table 1 from the right hand side to the left according to arrow n), and thus, is maintained resting against a stop 9 which is fixed relative to the room or space. Tilting of the pan 7 in counterclockwise direction thus can be effected only upon overcoming the maintaining or self-holding force caused by the torsion or rotational moment m and upon passing through an intermediate neutral or dead-center position where the torsion or rotational moment m becomes zero.

A contacting location or point, designated 10, is electrically insulated with respect to the feed table 1 in a manner known as such (compare the examples indicated in FIGS. 4 through 6). The contact of this contacting location or point 10 by the pan 7 closes an electric low current control circuit, also known as such to anyone skilled in the art, thereby causing immediate stopping of the drive motor (not shown) of the machine. The contacting point or contact location 10, together with the pan 7, forms a switch-off contact for the machine. Tilting of the pan 7 from the work position A into the stopping or shutdown position B can be effected under two principle reasons corresponding to two basic disturbances of the working conditions of the machine.

These two cases are shown schematically in FIGS. 3*b* and 3*c*.

In FIG. 3*b* the situation is shown, where the material supply from the can 6 is exhausted, i.e. the can 6 has been emptied, or the supply of the fibre sliver 2 from the can 6 is interrupted. In this case the pair of rolls 4/5 no longer transports any sliver 2, and thus, a free sliver end 11 necessarily passes across the pan or rocker 7. The free sliver end 11, in this process, falls onto the pan 7 and sweeps across it, since the fibre sliver 2 no longer is clamped between the rolls 4/5, and thus, no longer can pass in a tensioned state above the pan 7 whereby a distance is maintained therefrom during normal operation as has been depicted in FIG. 3*a*. According to the invention the torque or moment m is to be chosen just large enough that tilting or pivoting of the pan 7 in counterclockwise direction is effected fast and reliably under the influence of the sliver end 11 running out and acting in the opposite sense of rotation with respect to the torsion or rotational moment m. The influence of the sliver end 11 is caused by two forces, namely the weight of the sliver itself and the friction generated by its sweeping movement from right to left across the pan surface 12. The sum of these two forces should overcome the rotational moment m in such a manner that the pan 7 immediately tilts and comes into contact with the contacting point 10 or location, and thus, assumes its stopping position B. Consequently, the machine is stopped immediately.

In order to reduce the reaction or response time of the pan, it has proven to be advantageous to keep its mass low. This can be achieved by using light materials, such as e.g. light metal alloys, or by other design measures (such as e.g. by providing thereat recesses), as will be explained in more detail in the following with reference to further illustrated exemplary embodiments.

In FIG. 3*c* there is shown the function of the inventive stop motion apparatus in the case of the second type of basic disturbance, namely the case where the fibre sliver 2 breaks on the feed table 1, i.e. after passing through the pair of rolls 4/5, for any reason, e.g. due to excessive tensioning. In this case the pair of rolls 4/5 continues to supply fibre sliver, which however no longer is carried on, and thus, accumulates on the pan or rocker 7 as a fibre accumulation 13. Experience has shown that if the pan 7 is arranged in the immediate vicinity of the pair of rolls 4/5, as shown in the FIGS. 3*a* through 3*c*, and, by virtue of the high working speed which is presently used, the fibre sliver 2 so-to-speak "shoots" out of the nip of the pair of rolls 4/5 with a relatively high inertia, such that it preferentially hits the left hand side of the pan 7, which thus immediately is caused to tilt into the stopping position B. The dimensions of the pan 7 thus advantageously are chosen such that, while taking the working speed of the machine into account, the above mentioned sequence can be effected without time lag, which can easily be determined experimentally.

In FIG. 4 an advantageous design of a pan or rocker 7 is shown in an enlarged axonometric view. The plan 7 consists of two legs 14 and 15 which at the centre are connected by a hub 16. The hub 16 is provided with a bore, into which the tilting or pivot shaft 17 can be inserted slidingly. The tilting or pivot shaft 17 is fixed to a vertical side wall 18 of the feed table 1, in which arrangement the side wall 18 is electrically insulated with respect to the horizontal table surface 19 e.g. by using an insulating layer 20.

The weight of the leg 15, according to the invention, exceeds that of the leg 14 in such a manner that also here the rotational moment m can act upon the pan 7 in clockwise direction.

The left hand leg of the pan 7 shows two characteristics or features which are very favourable with respect to the reaction speed and to the reliability of the stop motion apparatus.

For the first purpose recesses 21 are provided in the bottom of the leg 14: the mass of the pan 7 thus is reduced, and its inertia is reduced correspondingly. For improving the reliability the comb-shaped teeth 22 are provided on the free, left hand end of the leg 14, which furthermore is angled upwards together with the lower portion of the leg 14. Owing to this shape of the pan 7, a sliver, which is running out, "engages" with the pan 7, or with its teeth respectively, in such a manner that the pan 7 securely is "carried on" or "entrained" for tilting.

In FIG. 4 there is further shown the manner in which there is established the electric contact between the pan 7 and the feed table 1, which is electrically insulated with respect to the tilting or pivot shaft 17. For this purpose the surface 19 of the table 1 is provided with an extension 23, against which the right hand leg 15 of the pan 7 is urged into contact in the stopping position B indicated with broken lines, the electric contact thus being established.

FIGS. 5 and 6 depict a further alternative design example of the inventive stop motion apparatus wherein there is attained maximum reaction or response speed of the stop motion.

The two-legged pan or rocker 7, the structure of which substantially corresponds to that of the pan shown in FIG. 4, differs therefrom in that here it is provided with a movable, relatively heavy mass, the movement of which relative to the pan generates an acceleration of the tilting movement of the pan from the working position A into the stopping position B. For this purpose an enlarged portion 25 is provided between the tilting or pivot shaft 24 and the two legs 14 and 15, in which there are provided a plurality, e.g. in the case illustrated, three chambers 26 in the form e.g. of bores. In these bores steel balls 27 are contained, which can move freely along the whole bore. Each chamber 26 is equipped with a sealing cover 28. The position of the chambers 26 with respect to the pan 7 is chosen such that their axis $h_1$ in the working position A (shown in FIG. 5 with solid lines) of the pan is inclined slightly towards the right, whereas in the stopping position B (shown in FIG. 5 with broken lines) the axis $h_2$ of the chambers 26 is inclined to the left, at a larger angle with respect to the horizontal line. During the movement of the pan from its working position A to its stopping position B the axis h of the chambers 26 thus moves through a horizontal position, in which the ball 27 contained in the chamber 26 is in a labile or unstable position.

The apparatus now functions as follows: If for any reason the pan 7 is caused to tilt from the working position A to the stopping position B it first moves counterclockwise until the axes h of the chambers 26 reach their horizontal position. The steel balls 27, which up to this moment have rested against the right hand side stop of the chambers 26, reach their labile or unstable position and start moving, also due to inertia, from the right hand side to the left in their respective chambers 26. Owing to the shift of the center of gravity of the pan 7 induced by this movement the counterclockwise movement of the pan 7 is accelerated in such a manner, that the pan 7 moves faster into its stopping position B, where an extension 29 establishes contact against the rim 30 of the feed table 1, which is electrically isolated from the tilting shaft 24, whereupon the machine is shut off.

The ball 27 of course here represents merely one example of a body, which is made from a relatively heavy material, and which is movable at right angles with respect to the tilting or pivot shaft of the pan 7, and the function of which body is to increase the tilting moment k acting upon the pan 7. A further advantage of this solution is seen in that, in addition to the above mentioned reduction of the reaction time, the contacting pressure, i.e. the pressure exerted upon the contacting point between the rim 30 and the extension 29 is increased, the reliability of the stop motion apparatus thus being improved.

Owing to the fact that the electric stop motion apparatus described in its working position A does not contact the processed textile material, the disadvantages of the state of the art mentioned initially are avoided when the inventive apparatus is used, namely the danger of contamination of the apparatus and the danger of damaging the throughpassing fibre sliver. This improves the reliability of the stop motion apparatus which, as in all control devices which are to function rarely but reliably, can be jeopardized by contamination and improves the quality of the processed fibre slivers, since there is precluded the formation of dangerous "fibre beards", which periodically are transported by the fibre sliver and which may cause a serious defect impairing the quality all the way to the finished product. Furthermore, the inventive apparatus is characterized by its very short reaction or response time, particularly as concerns the last mentioned embodiment, and thus, the subsequent action of piecing the missing sliver is facilitated.

While there are shown and described present preferred embodiments of the invention, it is to be distinctly understood that the invention is not limited thereto, but may be otherwise variously embodied and practiced within the scope of the following claims. Accordingly,

What we claim is:

1. An electric stop motion apparatus for a textile machine which is fed with traveling fiber slivers, particularly a drawframe, wherein a respective pair of feed rolls are provided for each fibre sliver for feeding the fiber sliver in a predetermined direction of travel, comprising:

a respective tiltable pan provided for each infed fiber sliver;

means mounting each said tiltable pan for tilting movement between a working position and a stop position;

tilting of said tiltable pan being accomplished by depletion of the fiber sliver either upstream or downstream of the related pair of feed rolls with respect to said predetermined direction of travel of the sliver, in order to thus activate an electric stop motion contact upon depletion of the fiber sliver either upstream or downstream of said related pair of feed rolls;

said tiltable pan being arranged beneath the normally running fiber sliver without being in contact with said fiber sliver;

said mounting means for said tiltable pan defining a horizontal tilt axis arranged substantially perpendicular to the direction of travel of the fiber sliver;

stop means positioned to cooperate with said tiltable pan;

said tiltable pan possessing a mass distribution which is selected such that when the pan is in its working position it is maintained against said stop means through a self-holding action exerted by said tiltable pan; and tilting of the pan into its working position being accomplished by overcoming the self-holding action of said tiltable pan through the application of an external force while the tiltable pan passes through an unstable neutral position.

2. The electric stop motion as defined in claim 1, further including:

at least one body made from a relatively heavy material; and said at least one body being movably guided upon said pan at substantially right angles to said tilt axis thereof in a manner such that upon passage of said tiltable pan through said neutral position said body moves relative to said pan and brings about an increase in the tilting moment acting upon said tiltable pan.

3. The electric stop motion apparatus as defined in claim 2, wherein:

said tiltable pan is provided with means defining an elongate chamber; and said body comprising a steel ball movable in said elongate chamber.

4. The electric stop motion apparatus as defined in claim 2, wherein:

said tiltable pan has a portion which extends in the direction of travel of the fiber sliver; and said extending portion of said tiltable pan being provided with substantially comb-shaped teeth.

5. The electric stop motion apparatus as defined in claim 1, wherein:

said tiltable pan is structured to possess a low mass.

6. The electric stop motion apparatus as defined in claim 5, wherein:

said tiltable pan is made from a light metal alloy.

7. The electric stop motion apparatus as defined in claim 1, wherein:

said mounting means for said tiltable pan comprises a pivot shaft;

a feed table;

said pivot shaft being mounted on and being electrically insulated from said feed table; and said tiltable pan when in its stop position coming into contact with and resting against the table in order to establish a stopping contact for actuating the stop motion apparatus.

8. The electric stop motion apparatus as defined in claim 1, wherein:

said tiltable pan tilting in the direction of the fiber sliver upon depletion of said fiber sliver.

* * * * *